US007576491B2

(12) United States Patent
Ahn

(10) Patent No.: US 7,576,491 B2
(45) Date of Patent: Aug. 18, 2009

(54) PLASMA DISPLAY PANEL HAVING BUFFER LAYER BETWEEN SEALING LAYER AND SUBSTRATE AND METHOD OF FABRICATING THE SAME

(75) Inventor: Young Joon Ahn, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/830,068

(22) Filed: Apr. 23, 2004

(65) Prior Publication Data

US 2004/0212306 A1 Oct. 28, 2004

(30) Foreign Application Priority Data

Apr. 25, 2003 (KR) ..... 10-2003-0026401

(51) Int. Cl.
*H01J 17/49* (2006.01)

(52) U.S. Cl. ..... 313/586; 313/582; 313/587

(58) Field of Classification Search ..... 313/582–587, 313/292; 445/24–25
See application file for complete search history.

(56) References Cited

U.S. PATENT DOCUMENTS

| | | | | |
|---|---|---|---|---|
| 3,849,190 | A | 11/1974 | Foster et al. | |
| 4,320,418 | A | 3/1982 | Pavliscak | |
| 5,336,121 | A * | 8/1994 | Baret | 445/25 |
| 5,972,564 | A * | 10/1999 | Kawana et al. | 430/281.1 |
| 6,097,149 | A * | 8/2000 | Miyaji et al. | 313/582 |
| 6,218,777 | B1 * | 4/2001 | Jones et al. | 313/495 |
| 6,242,859 | B1 | 6/2001 | Betsui | |
| 6,261,144 | B1 * | 7/2001 | Nishiki et al. | 445/24 |
| 6,414,434 | B1 * | 7/2002 | Nakano et al. | 313/582 |
| 6,495,262 | B2 * | 12/2002 | Igeta | 428/426 |
| 6,514,111 | B2 * | 2/2003 | Ebihara et al. | 445/25 |
| 6,605,834 | B1 * | 8/2003 | Lee | 257/295 |
| 6,614,412 | B1 * | 9/2003 | Hirano et al. | 345/60 |
| 6,761,608 | B2 * | 7/2004 | Tanaka et al. | 445/25 |
| 6,774,562 | B2 * | 8/2004 | Roche et al. | 313/582 |
| 6,803,723 | B1 | 10/2004 | Yamashita et al. | |
| 6,827,623 | B2 * | 12/2004 | Nakatake et al. | 445/25 |
| 6,833,672 | B2 | 12/2004 | Aoki et al. | |
| 2001/0038365 | A1 | 11/2001 | Igeta et al. | |
| 2002/0036466 | A1 * | 3/2002 | Tanaka et al. | 313/586 |
| 2003/0102803 | A1 * | 6/2003 | Chang | 313/586 |

(Continued)

FOREIGN PATENT DOCUMENTS

| | | |
|---|---|---|
| EP | 0 788 131 | 8/1997 |

(Continued)

OTHER PUBLICATIONS

European Search Report dated Feb. 3, 2009.

*Primary Examiner*—Karabi Guharay
(74) *Attorney, Agent, or Firm*—KED & Associates, LLP

(57) ABSTRACT

A plasma display panel that is adaptive for improving yield and mass productivity and a fabricating method thereof. A plasma display panel according to an embodiment of the present invention includes a first substrate; a second substrate facing the first substrate with a discharge space therebetween; a sealing layer located between the first substrate and the second substrate; and a buffer layer formed between the first substrate and the sealing layer to compensate the thermal stress of the first substrate and the sealing layer.

22 Claims, 23 Drawing Sheets

U.S. PATENT DOCUMENTS

| | | | | |
|---|---|---|---|---|
| 2005/0029938 | A1 * | 2/2005 | Kwon et al. | 313/582 |
| 2006/0119265 | A1 * | 6/2006 | Cho | 313/582 |

FOREIGN PATENT DOCUMENTS

| | | |
|---|---|---|
| JP | 2001-1166284 | 6/2001 |
| KR | 102000011255 | 2/2000 |
| KR | 1020010056987 | 7/2001 |
| WO | WO 01/29858 | 4/2001 |

* cited by examiner

PLASMA DISPLAY PANEL HAVING BUFFER LAYER BETWEEN SEALING LAYER AND SUBSTRATE AND METHOD OF FABRICATING THE SAME

This application claims the benefit of the Korean Patent Application No. P2003-26401 filed in Korea on Apr. 25, 2003, which is hereby incorporated by reference.

BACKGROUND OF THE INVENTION

1. Field of the Invention

The present invention relates to a plasma display panel, and more particularly to a plasma display panel that is adaptive for improving yield and mass productivity and a fabricating method thereof.

2. Description of the Related Art

A plasma display panel (hereinafter 'PDP') has light emission of phosphorus caused by ultraviolet rays of 147 nm that is generated upon discharge of inert mixed gas such as He+Xe, Ne+Xe, He+Xe+Ne, thereby displaying a picture including characters or graphics. Such a PDP is easy to be made into a thin-film and large-dimension type of it. Moreover, the PDP provides a very improved picture quality owing to recent technical development.

Referring to FIG. 1, a discharge cell of a three-electrode AC surface discharge type PDP includes a sustain electrode pair 4 formed on an upper substrate 16 and an address electrode 2 formed on a lower substrate 14.

Each of the sustain electrode pair 4 includes a transparent electrode 4A of indium tin oxide ITO and a metal bus electrode 4B formed at one side of the edge of the transparent electrode 4A. An upper dielectric layer 12 and a protective film 10 are deposited on the upper substrate 16 where the sustain electrode pair 4 has been formed. Wall charges generated upon plasma discharge are accumulated in the upper dielectric layer 12. The protective film 10 prevents the upper dielectric layer 12 and the sustain electrode pair 4 from being damaged due to sputtering generated upon plasma discharge, and in addition, it increases the emission efficiency of secondary electron. The protective film 10 is normally magnesium oxide MgO.

A lower dielectric layer and barrier ribs 8 are formed on the lower substrate 14 where address electrode 2 has been formed, and a phosphorus 6 is formed on the surface of the lower dielectric layer 18 and the barrier ribs 8. The address electrode 2 is orthogonal to the sustain electrode pair 4. The barrier ribs 8 are formed along the address electrode 2 to prevent the ultraviolet ray and visible ray generated by discharge from leaking out to adjacent discharge cells. The phosphorus 6 is excited by the vacuum ultraviolet ray generated upon plasma discharge to generate any one of red, green or blue visible ray.

Inert mixed gas such as He+Xe, Ne+Xe, He+Xe+Ne is injected for discharge into a discharge space of the discharge cell provided between the upper/lower substrate 16, 14 and the barrier ribs 8.

On the other hand, the lower substrate 14 where the address electrode 2 has been formed is joined with the upper substrate 16 where the sustain electrode pair 4Y, 4Z has been formed, as shown in FIG. 2, by a sealing layer 50.

FIGS. 3A to 3D are sectional diagrams representing a sealing process of PDP of prior art.

Firstly, the sustain electrode pair 4Y, 4Z and the upper dielectric layer 12 are formed on the upper substrate 16, as shown in FIG. 3A.

The sealing layer 50, as shown in FIG. 3B, is formed on the upper substrate 16 where the upper dielectric layer 12 has been formed. The sealing layer 50 is formed by spreading sealing-paste in use of a screen printing or a dispenser, wherein the sealing-paste is formed by mixing glass powder, solvent and binder together.

Subsequently, under the environment of 200~300° C., the protective film 10 is formed on the upper substrate 16 in use of E-beam deposition or sputtering methods, as shown in FIG. 3C.

Subsequently, the upper substrate 16 is aligned with the lower substrate 14 while the upper substrate 16 where the sealing layer 50 has been formed is pressed against and joined with the lower substrate 14. The aligned upper substrate 16 and lower substrate 14 are fired to remove a large amount of solvent and organic material which are contained within the sealing layer 50, thereby joining the upper/lower substrate 16, 14, as shown in FIG. 3D.

However, after the protective film 10 is formed under the environment of 200–300° C., there occurs a crack in the area of the upper substrate 16 contacted with the sealing layer 50 due to the difference of thermal expansion coefficient between the upper substrate 16 and the sealing layer 50 in the course that it cools down to normal temperature. The difference of such thermal expansion coefficients generates partial thermal stress on a part where the upper substrate 16 is in contact with the sealing layer 50. There is generated a thermal stress which is relatively bigger in the upper substrate 16 than in the sealing layer 50, wherein the upper substrate 16 has relatively bigger thermal expansion coefficient than the sealing layer 50, and the thermal stress causes the crack to be generated in the upper substrate 16.

Accordingly, there is a problem that the yield and mass productivity of PDP is decreased.

SUMMARY OF THE INVENTION

Accordingly, it is an object of the present invention to provide a plasma display panel that is adaptive for improving yield and mass productivity and a fabricating method thereof.

In order to achieve these and other objects of the invention, a plasma display panel according to an aspect of the present invention includes a first substrate; a second substrate facing the first substrate with a discharge space therebetween; a sealing layer located between the first substrate and the second substrate; and a buffer layer formed between the first substrate and the sealing layer to compensate the thermal stress of the first substrate and the sealing layer.

The buffer layer is composed of PbO of 45~55%, B2O3 of 10~20%, Al2O3 of 10~20% and SiO2 of 15~25%.

The thermal expansion coefficient of the buffer layer is different from the thermal expansion coefficient of the first substrate.

The thermal expansion coefficient of the buffer layer is the same as the thermal expansion coefficient of the first substrate.

The thermal expansion coefficient of the buffer layer is different from the thermal expansion coefficient of the sealing layer.

The thermal expansion coefficient of the buffer layer is the same as the thermal expansion coefficient of the sealing layer.

The thermal expansion coefficient of the first substrate is around $80\times10^{-7}$~$95\times10^{-7}$/° C.

The thermal expansion coefficient of the sealing layer is around $65\times10^{-7}$~$80\times10^{-7}$/° C.

The thermal expansion coefficient of the buffer layer is around $72\times10^{-7}$~$86\times10^{-7}$/° C.

The plasma display panel further includes a protective film formed on the first substrate where the buffer layer has been formed.

The plasma display panel further includes an upper dielectric layer formed on the first substrate; and a protective film formed on the upper dielectric layer.

The buffer layer is formed to be extended from the upper dielectric layer.

The buffer layer is separately formed of a different material from the upper dielectric layer.

The buffer layer is formed of the same material as the upper dielectric layer.

A fabricating method of a plasma display panel according to another aspect of the present invention includes the steps of: forming a buffer layer on a first substrate; and forming a sealing layer on the buffer layer.

The fabricating method further includes the steps of: providing a second substrate facing the first substrate where the sealing layer has been formed; and joining the first substrate with the second substrate.

The fabricating method further includes the steps of: forming an upper dielectric layer on the first substrate; and forming a protective film on the upper dielectric layer.

In the fabricating method, the buffer layer is composed of PbO of 45~55%, B2O3 of 10~20%, Al2O3 of 10~20% and SiO2 of 15~25%.

In the fabricating method, the thermal expansion coefficient of the buffer layer is different from the thermal expansion coefficient of the first substrate.

In the fabricating method, the thermal expansion coefficient of the buffer layer is the same as the thermal expansion coefficient of the first substrate.

In the fabricating method, the thermal expansion coefficient of the buffer layer is different from the thermal expansion coefficient of the sealing layer.

In the fabricating method, the thermal expansion coefficient of the buffer layer is the same as the thermal expansion coefficient of the sealing layer.

In the fabricating method, the thermal expansion coefficient of the first substrate is around $80\times10^{-7}$~$95\times10^{-7}$/° C.

In the fabricating method, the thermal expansion coefficient of the sealing layer is around $65\times10^{-7}$~$80\times10^{-7}$/° C.

In the fabricating method, the thermal expansion coefficient of the buffer layer is around $72\times10^{-7}$~$86\times10^{-7}$/° C.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 4 to 12C, embodiments of the present invention will be explained as follows.

Figure 1:
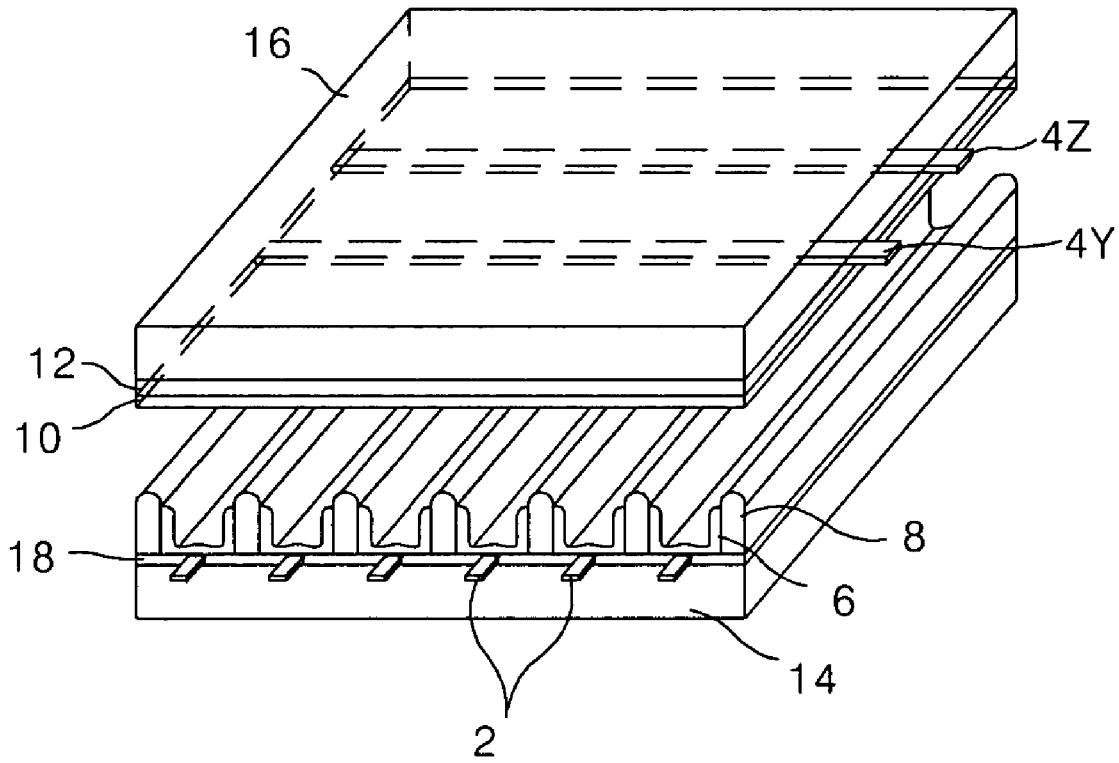
FIG. 1 RELATED ART
FIG. 1 is a perspective view representing a discharge cell structure of a 3-electrode AC type plasma display panel of prior art.
Figure 2:
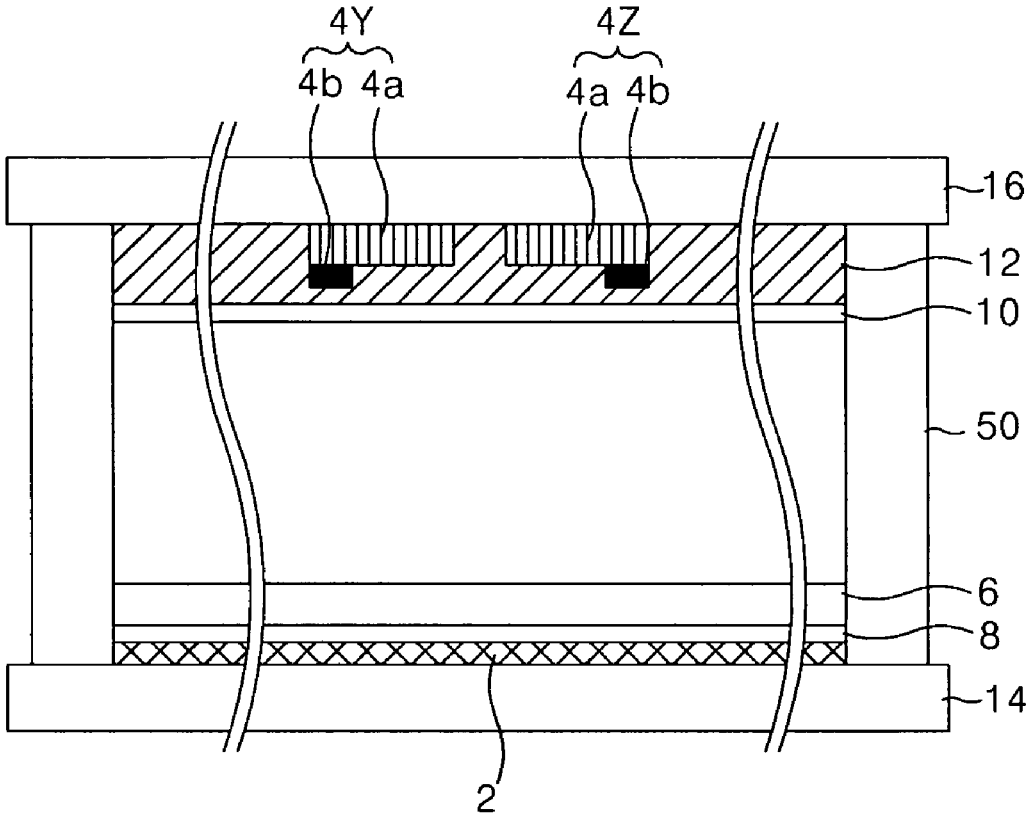
FIG. 2 RELATED ART
FIG. 2 is a sectional diagram representing a discharge cell structure of the plasma display panel, as shown in FIG. 1.
Figure 3A:
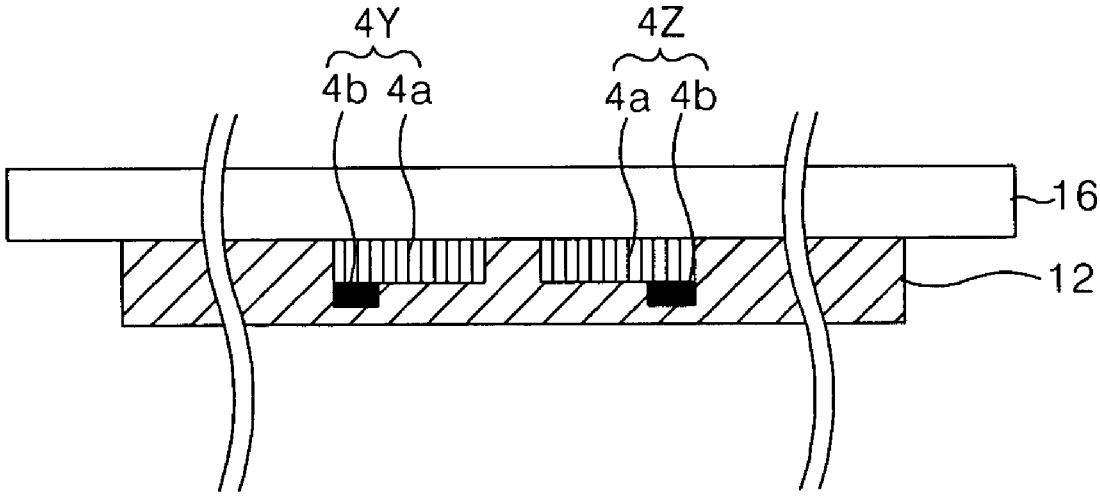
FIG.3A RELATED ART
FIGS. 3A to 3D are sectional diagrams representing a sealing process of the plasma display panel of prior art.
Figure 3B:
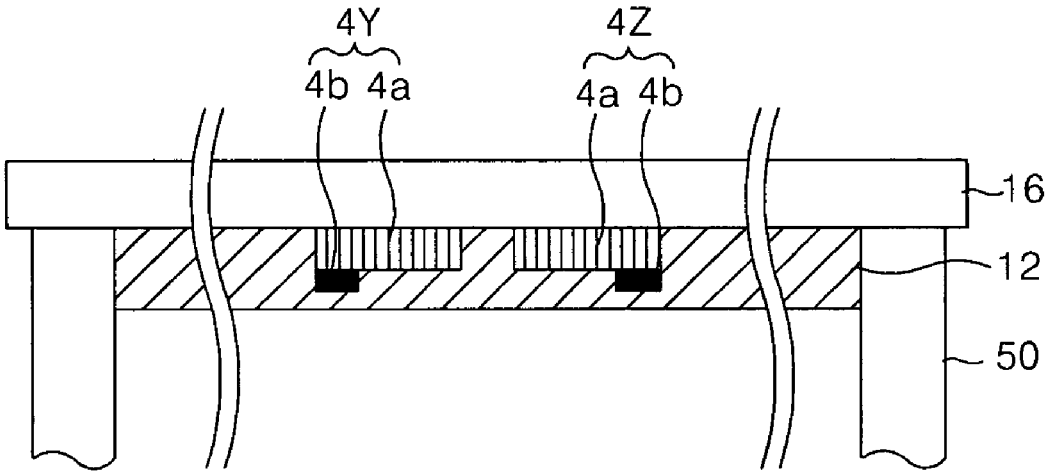
FIG.3B RELATED ART
Figure 3C:
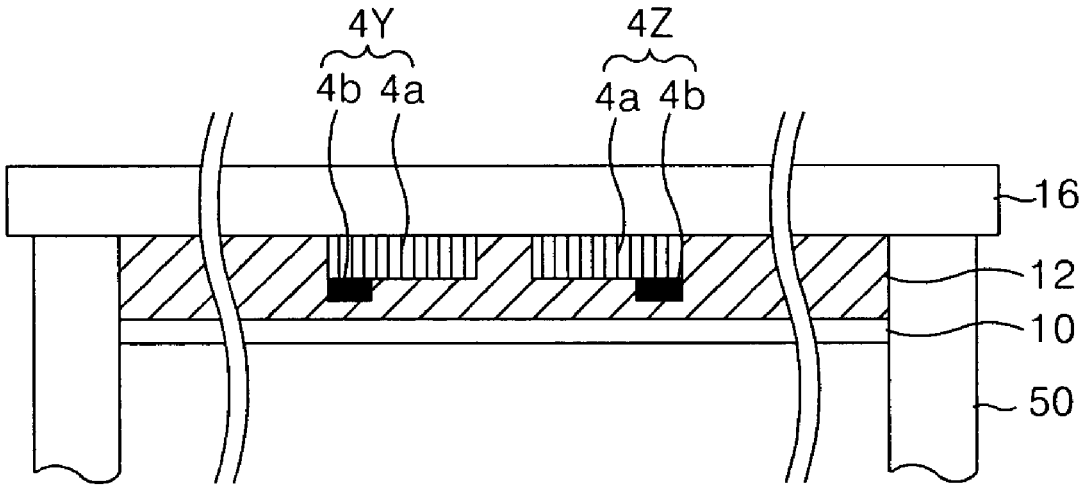
FIG.3C RELATED ART
Figure 3D:
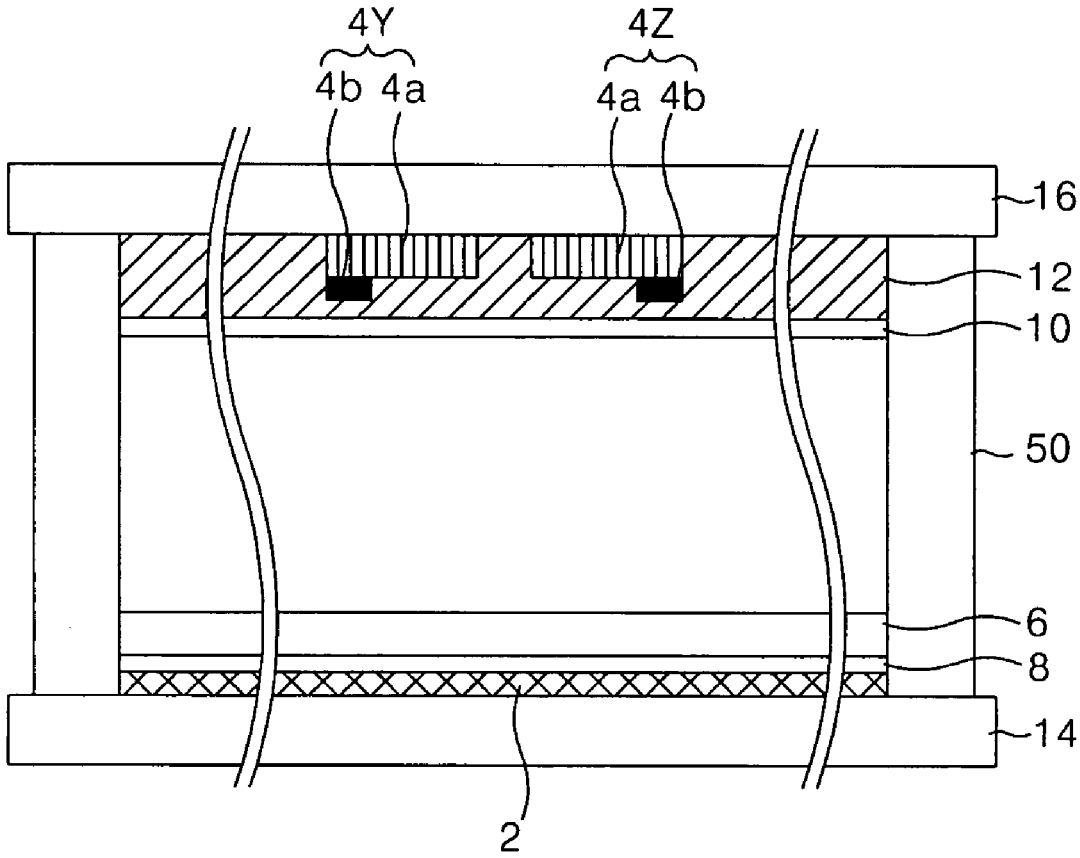
FIG.3D RELATED ART
Figure 4:
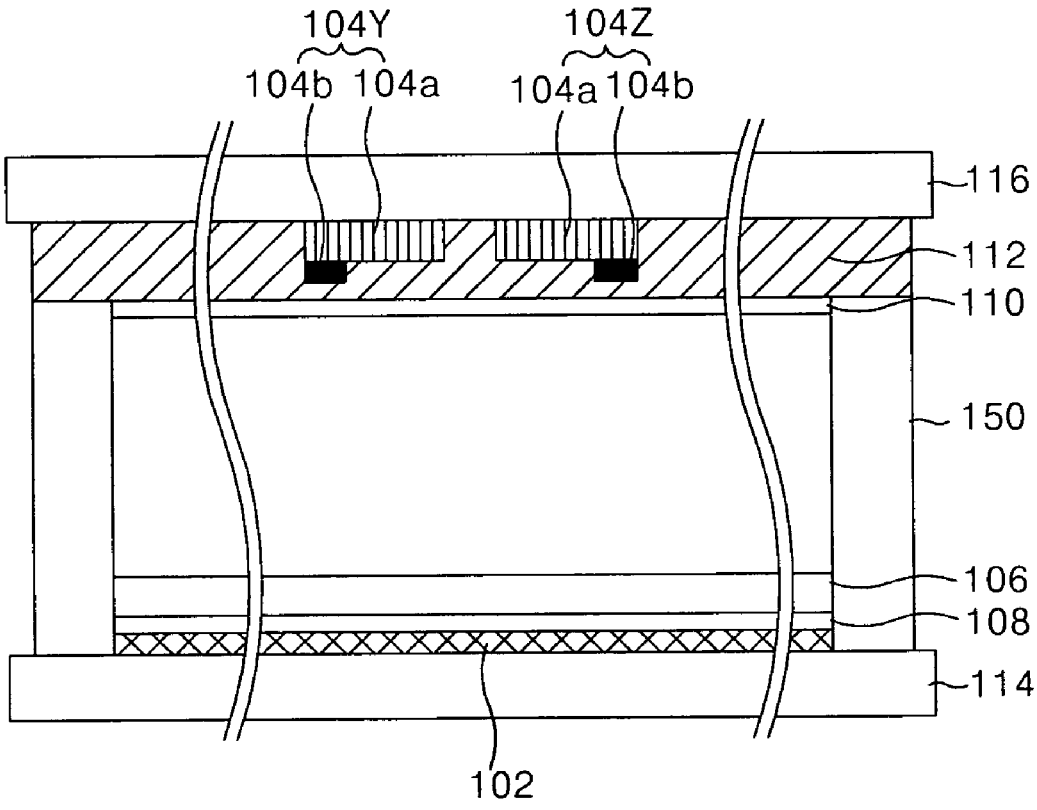
FIG. 4 is a sectional diagram representing a discharge cell structure of a plasma display panel according to a first embodiment of the present invention.

FIG. 4 is a sectional diagram representing a PDP according to a first embodiment of the present invention.

Referring to FIG. 4, a discharge cell of a 3-electrode AC surface discharge type PDP includes a sustain electrode pair 104Y, 104Z formed on an upper substrate 116, and an address electrode 102 formed on a lower substrate 114. Herein, a sealing layer 150 joins the upper substrate 116 with the lower substrate 114.

Each of the sustain electrode pair 104Y, 104Z includes a transparent electrode 104A of indium tin oxide ITO and a metal bus electrode 104B formed at one side of the edge of the transparent electrode 104A. An upper dielectric layer 112 and a protective film 110 are deposited on the upper substrate 116 where the sustain electrode pair 104Y, 104Z have been formed. The upper dielectric layer 112 is extended to the sealing area of the upper substrate 116, so as to be in contact with the sealing layer. Also, wall charges generated upon plasma discharge are accumulated in the upper dielectric layer 112. The protective film 110 prevents the upper dielectric layer 112 and the sustain electrode pair 104 from being damaged due to sputtering generated upon plasma discharge, and in addition, it increases the emission efficiency of secondary electron. The protective film 110 is normally magnesium oxide MgO.

A lower dielectric layer 118 and barrier ribs 108 are formed on the lower substrate 114 where the address electrode 102 has been formed, and a phosphorus 106 is formed on the surface of the lower dielectric layer 118 and the barrier ribs 108. The address electrode 102 is orthogonal to the sustain electrode pair 104Y, 104Z. The barrier ribs 108 are formed along the address electrode 102 to prevent the ultraviolet ray and visible ray generated by discharge from leaking out to adjacent discharge cells. The phosphorus 106 is excited by the vacuum ultraviolet ray generated upon plasma discharge to generate any one of red, green or blue visible ray.

Inert mixed gas such as He+Xe, Ne+Xe, He+Xe+Ne is injected for discharge into a discharge space of the discharge cell provided between the upper/lower substrate 116, 114 and the barrier ribs 108.

On the other hand, the upper dielectric layer 112 according to the first embodiment of the present invention is formed between the upper substrate 116 and the sealing layer 150 to alleviate the difference of thermal stress between them. To explain this in detail, the upper substrate 116 has a first thermal expansion coefficient, the sealing layer 150 has a second thermal expansion coefficient relatively lower than the first thermal expansion coefficient, and the upper dielectric layer 112 has a third thermal expansion coefficient between the first and second thermal expansion coefficients. For example, the thermal expansion coefficient of the upper substrate 116 is $80\times10^{-7}$~$95\times10^{-7}$/° C., the thermal expansion coefficient of the sealing layer 150 is $65\times10^{-7}$~$80\times10^{-7}$/° C., and the thermal expansion coefficient of the upper dielectric layer 112 is $72\times10^{-7}$~$86\times10^{-7}$/° C.

Accordingly, the upper dielectric layer 112 located between the upper substrate 116 and the sealing layer 150 disperses the thermal stress caused by the difference of thermal expansion coefficient between the upper substrate 116 and the sealing layer 150 in the course that the upper substrate 116 cools down to normal temperature after the protective film 110 is formed under the environment of 200~300° C. Since the thermal stress is dispersed by the upper dielectric layer 112, it is possible to prevent a crack from occurring in the upper substrate 116 that overlaps with the sealing layer 150 while having the upper dielectric layer 112 therebetween. Herein, the composition and content of the upper dielectric layer 112 is as follows.

TABLE 1

| Composition | PbO | $B_2O_3$ | $Al_2O_3$ | $SiO_2$ |
|---|---|---|---|---|
| Content | 45~55% | 10~20% | 10~20% | 15~20% |

Figure 5:
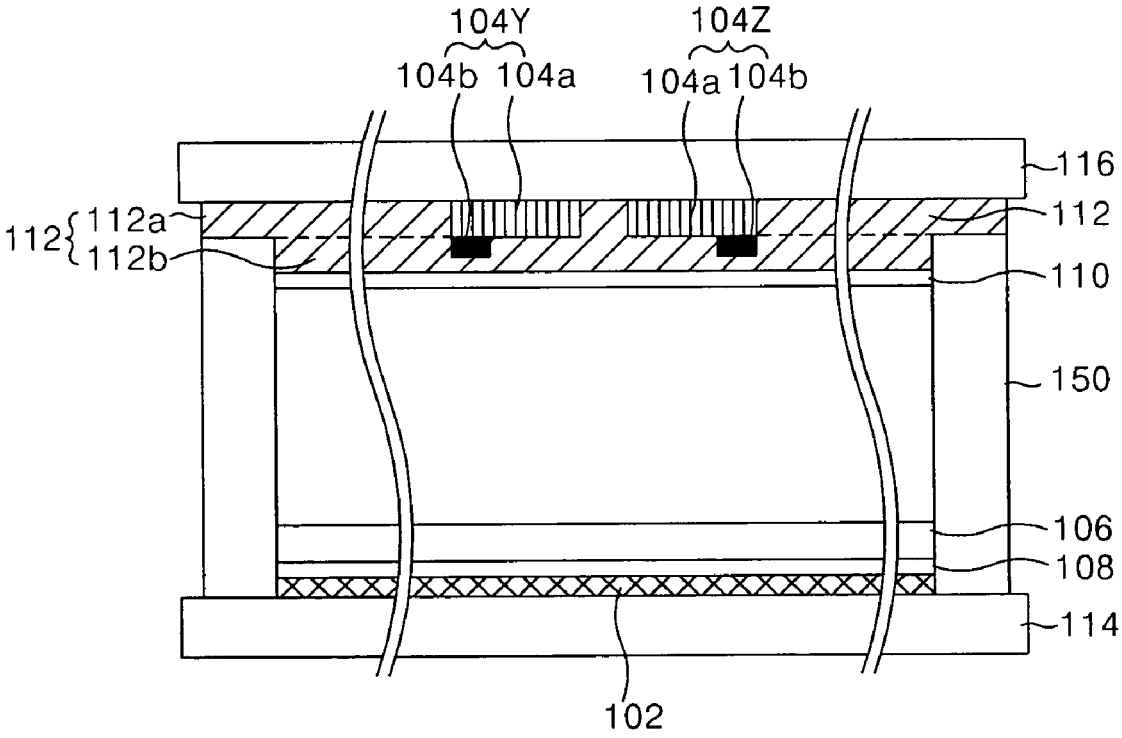
FIG. 5 is a diagram representing that an upper dielectric layer of the plasma display panel according to the first embodiment of the present invention is double-layered.

On the other hand, as shown in FIG. 5, the upper dielectric layer 112 of the PDP according to the first embodiment of the present invention can be formed to be a double layer, and the sealing layer 150 can be formed on a first lower dielectric layer 112A that has been formed on the substrate 116.

FIGS. 6A to 6D are sectional diagrams representing a sealing process of the PDP according to the embodiment of the present invention.

Figure 6A:
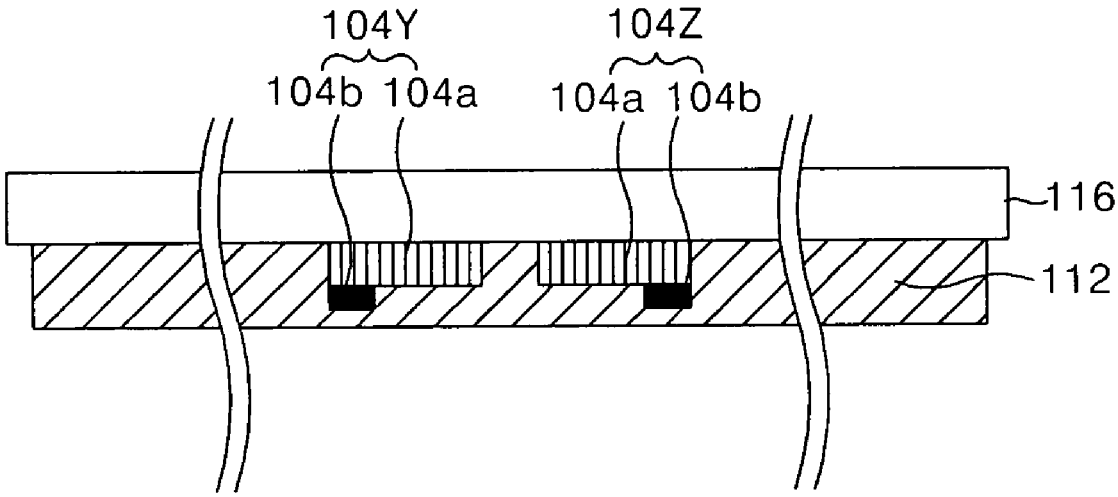
FIG. 6A to 6D are sectional diagrams representing a sealing process of the plasma display panel according to the first embodiment of the present invention.
Figure 6B:
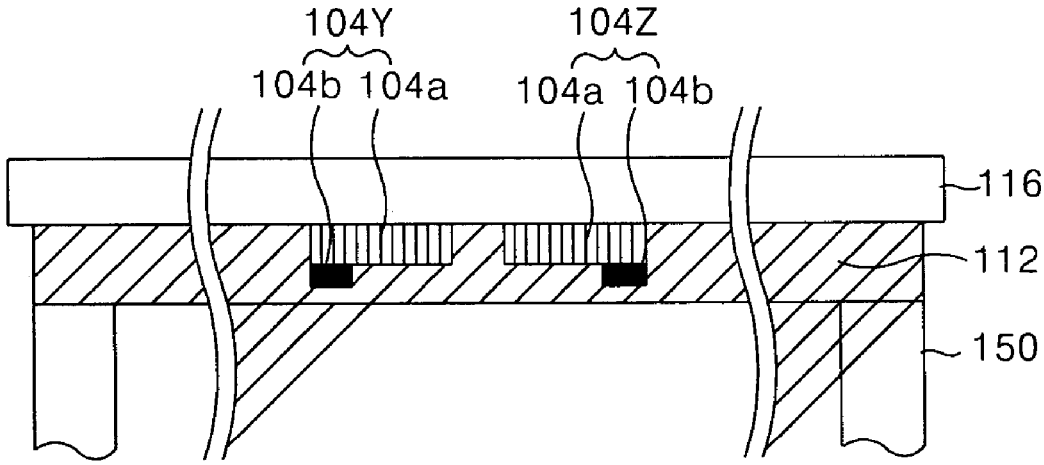

Firstly, an upper dielectric layer material is spread on the upper substrate 116 on which the sustain electrode pair 104Y, 104Z have been formed, thereby forming the upper dielectric layer 112 on the front surface of the upper substrate 116, as shown in FIG. 6A. The sealing layer 150 is formed on the upper substrate 116 where the upper dielectric layer 112 has been formed, as shown in FIG. 6B. The sealing layer 150 is formed by spreading a paste in use of screen printing or dispenser, wherein the paste is formed by mixing glass powder, solvent and binder together.

Figure 6C:
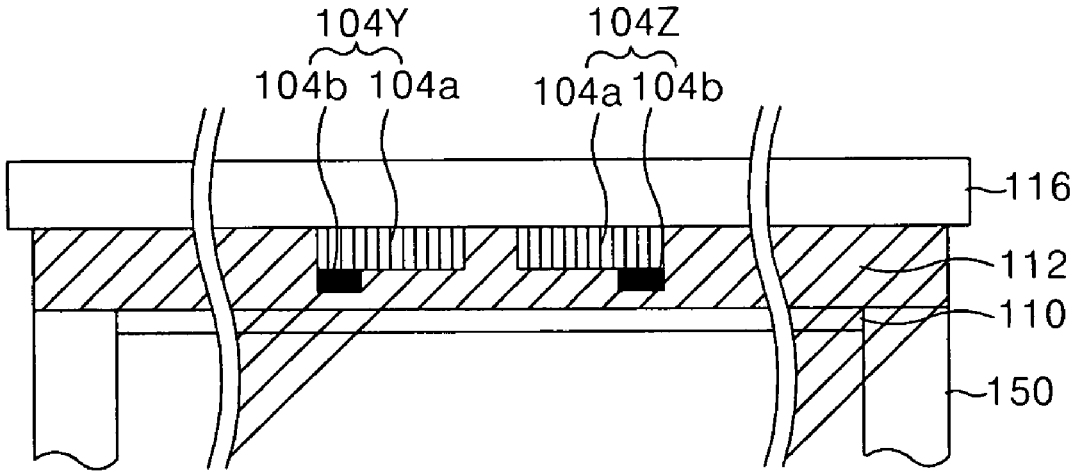

Subsequently, as shown in FIG. 6C, a protective film 110 is formed on the upper substrate 116, on which the sealing layer 150 has been formed, by using E-beam deposition or sputtering method under the environment of 200~300° C.

Figure 6D:
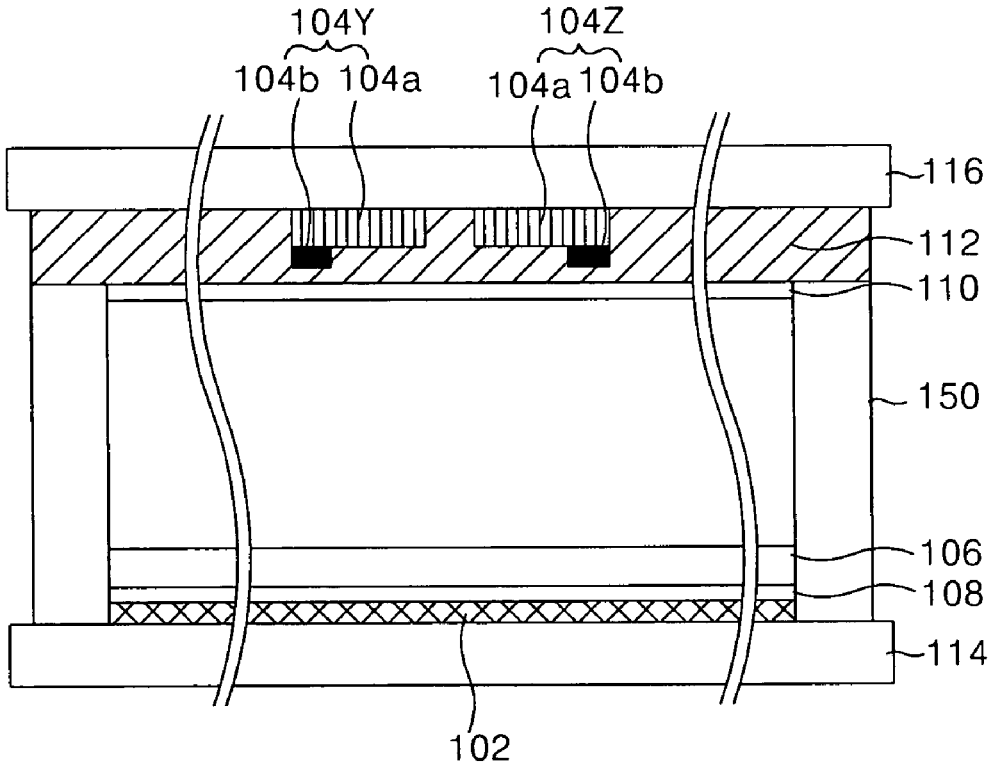

Subsequently, the upper substrate 116 where the sealing layer 150 has been formed is aligned with the lower substrate 114. The aligned upper substrate 116 and the lower substrate 114 are fired to remove a large amount of solvent and organic material which is contained within the sealing layer, thereby joining the upper/lower substrate 116, 114, as shown in FIG. 6D.

Figure 7:
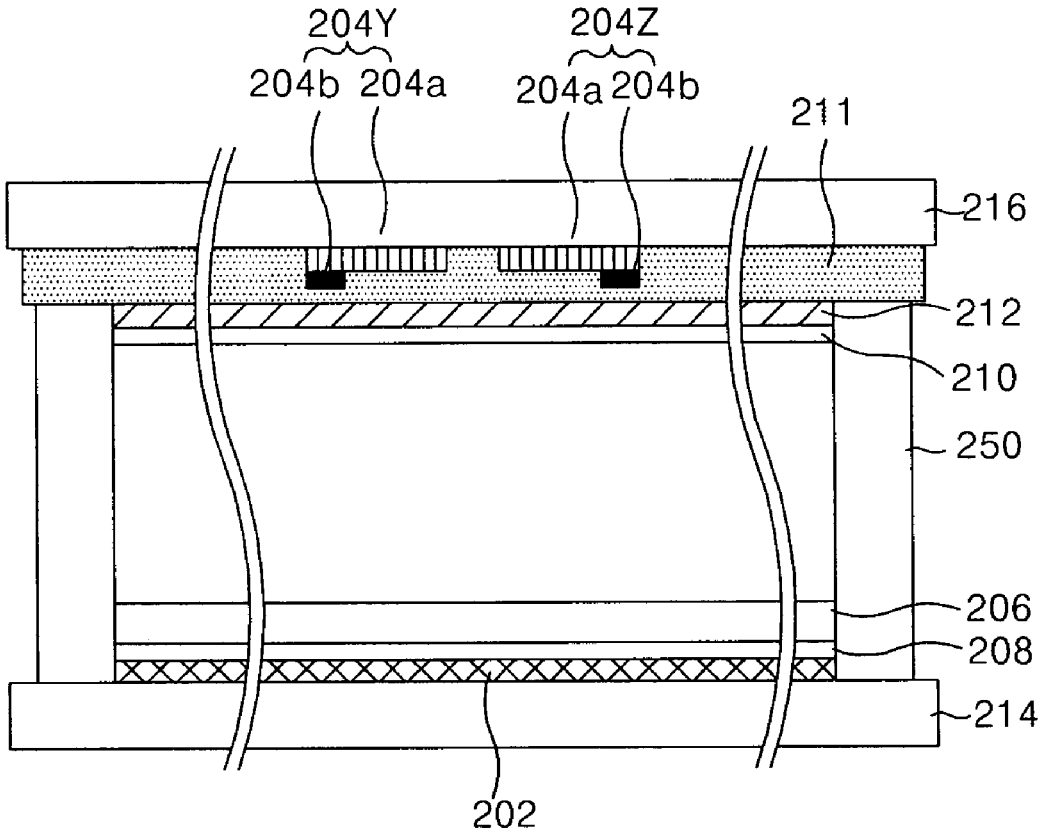
FIG. 7 is a sectional diagram representing a discharge cell structure of a plasma display panel according to a second embodiment of the present invention.

FIG. 7 is a sectional diagram representing a PDP according to a second embodiment of the present invention.

Referring to FIG. 7, the PDP according to the second embodiment of the present invention, when compared with the PDP shown in FIG. 4, has the same components except that it further includes a buffer layer 211 between the upper substrate 216 and the upper dielectric layer 212, so there will be no detail explanation for the same components as shown in FIG. 4.

The buffer layer 211 is formed to be in contact with the sealing layer 250 at the lower part of the upper dielectric layer 212 and to have its thickness of 5~50 μm on the entire surface of the upper substrate 216.

The buffer layer 211 is made of a material that has its thermal expansion coefficient between the thermal expansion coefficient of the upper substrate 216 and the thermal expansion coefficient of the sealing layer 250. For example, the thermal expansion coefficient of the upper substrate 216 is $80\times10^{-7}$~$95\times10^{-7}$/° C., the thermal expansion coefficient of the sealing layer 250 is $65\times10^{-7}$~$80\times10^{-7}$/° C., and the thermal expansion coefficient of the buffer layer 211 is $72\times10^{-7}$~$86\times10^{-7}$/° C. The material included in the buffer layer 211 is the same material as in the upper dielectric layer 216.

Accordingly, the area of the buffer layer 211 that is in contact with the sealing layer 250 disperses the thermal stress caused by the difference of thermal expansion coefficient between the upper substrate 216 and the sealing layer 250. Since the thermal stress is dispersed by the buffer layer 211, it is possible to prevent a crack from occurring in the upper substrate 216. Herein, the composition and content of the buffer layer 211 is as in table 2, and it is the same as the composition and content of the upper dielectric layer 212.

TABLE 2

| Composition | PbO | $B_2O_3$ | $Al_2O_3$ | $SiO_2$ |
|---|---|---|---|---|
| Content | 45~55% | 10~20% | 10~20% | 15~25% |

Figure 8:
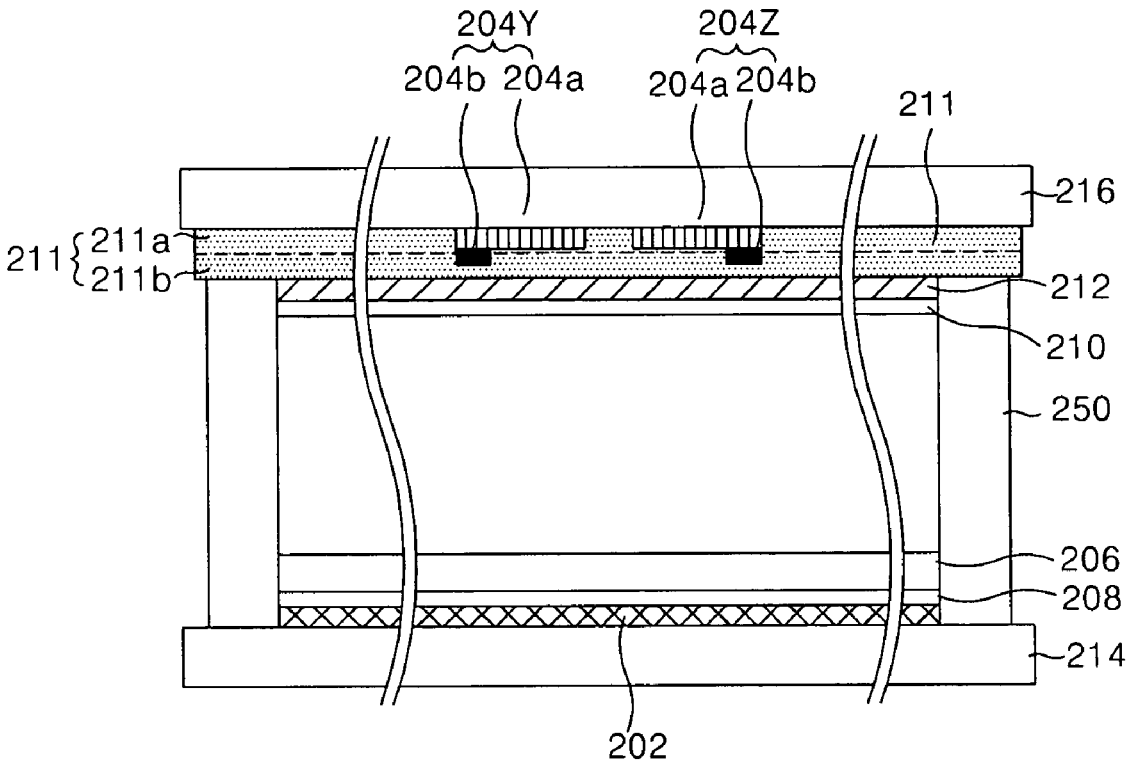
FIG. 8 is a diagram representing that a buffer layer of the plasma display panel according to the second embodiment of the present invention is double-layered.

On the other hand, as shown in FIG. 8, the buffer layer 211 of the PDP according to the second embodiment of the present invention can be formed to be a double layer of first and second buffer layers 211A, 211B, and the buffer layer 211 can be formed in the first buffer layer 211A so that it can have lower height than the buffer layer 211 of FIG. 7.

FIGS. 9A to 9D are sectional diagrams representing a sealing process of the PDP according to the embodiment of the present invention.

Figure 9A:
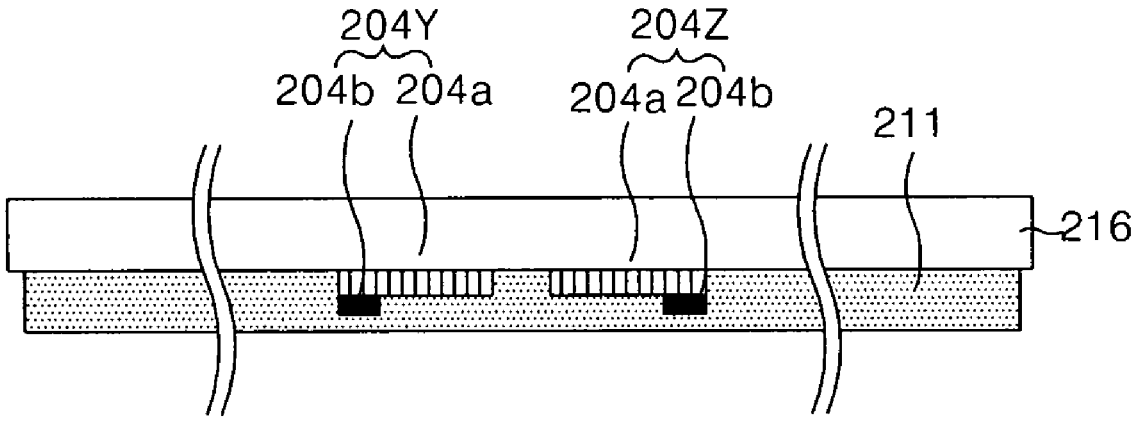
FIG. 9A to 9D are sectional diagrams representing a sealing process of the plasma display panel according to the second embodiment of the present invention.
Figure 9B:
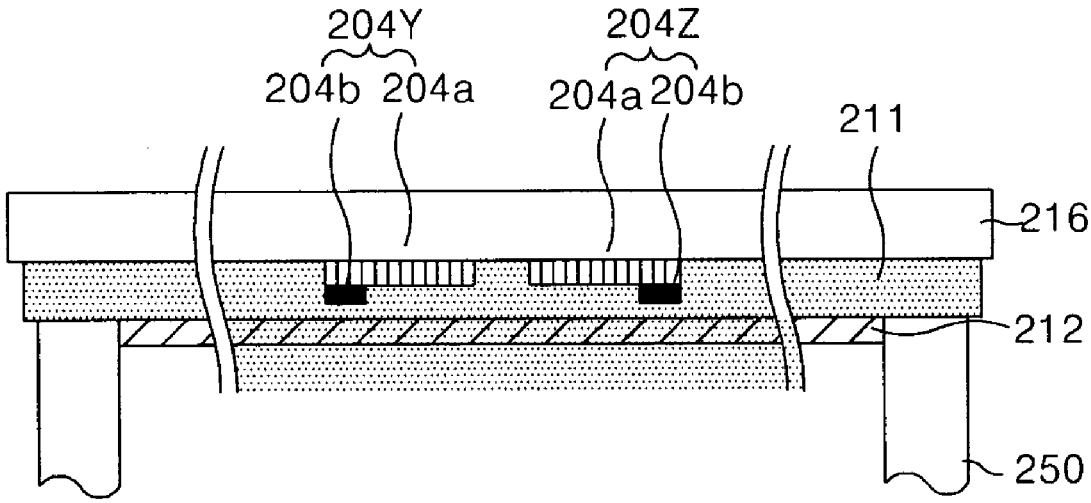

Firstly, the buffer layer 211 is formed on the front surface of the upper substrate 216 where the sustain electrode pair 204Y, 204Z have been formed, as shown in FIG. 9A. The upper dielectric layer 212 is formed in a display area on the buffer layer 211 by spreading a dielectric layer material on an area except for the sealing area of the upper substrate 216 where the buffer layer 211 has been formed. The sealing layer 250 is formed on the upper substrate 216 where the upper dielectric layer 212 has been formed, as shown in FIG. 9B. The sealing layer 250 is formed by spreading a sealing material paste in use of screen printing or dispenser, wherein the sealing material paste is formed by mixing glass powder, solvent and binder together.

Figure 9C:
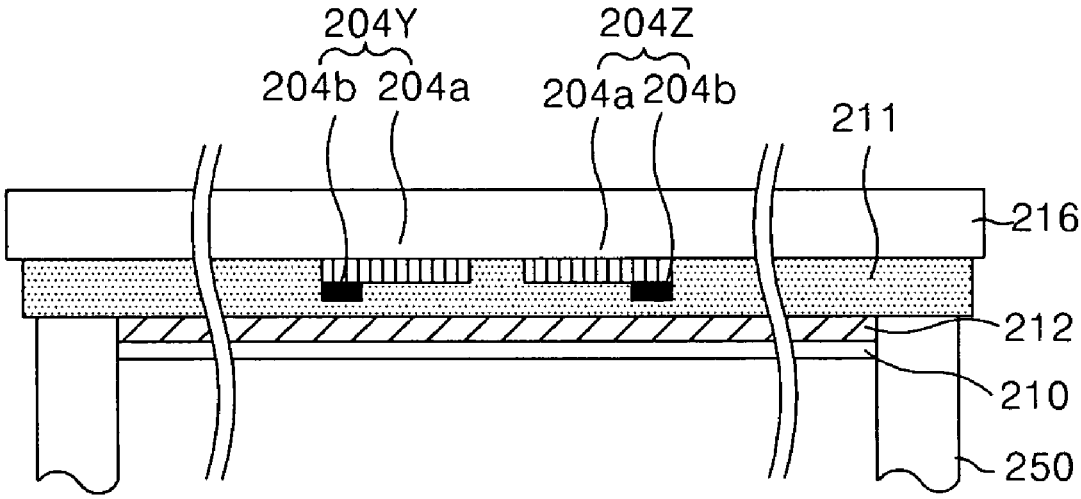

Subsequently, as shown in FIG. 9C, a protective film 210 is formed on the upper substrate 216, on which the sealing layer 250 has been formed, by using E-beam deposition or sputtering method under the environment of 200~300° C.

Figure 9D:
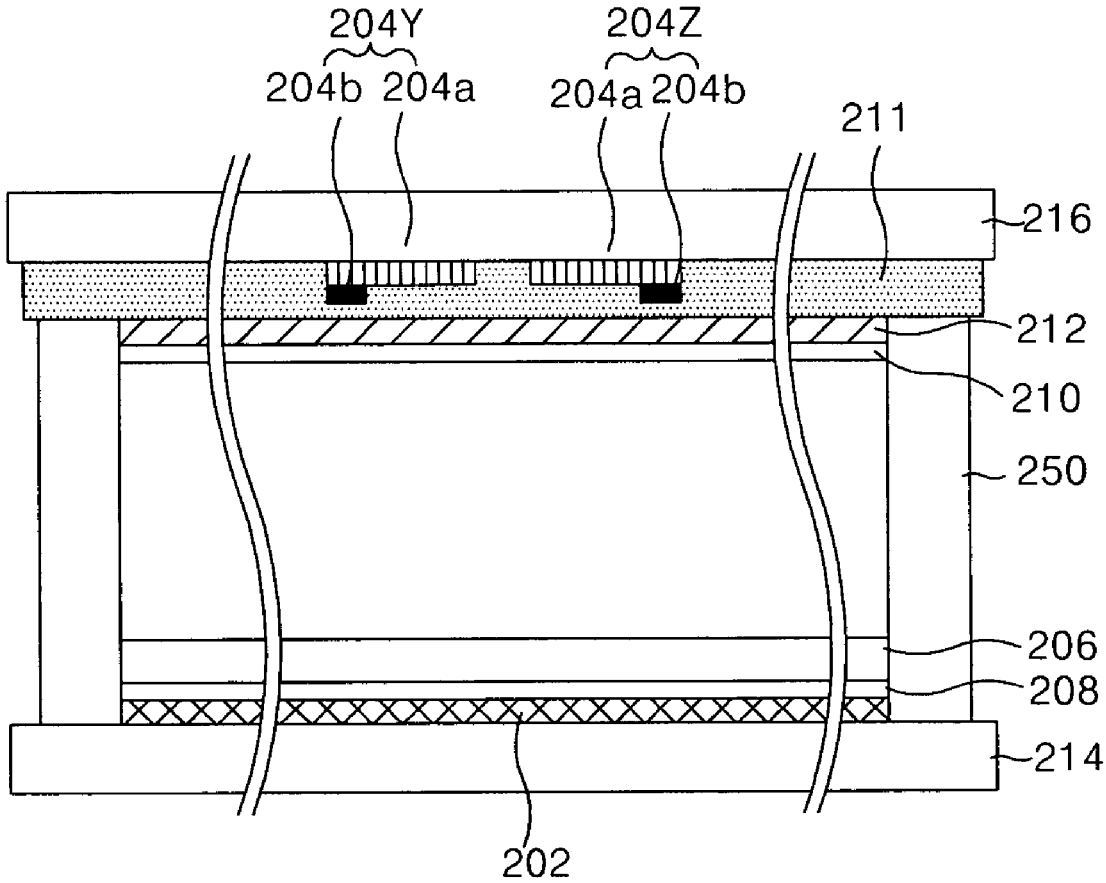

Subsequently, the upper substrate 216 where the sealing layer 250 has been formed is aligned with the lower substrate 214. The aligned upper substrate 216 and the lower substrate 214 are fired to remove a large amount of solvent and organic material which is contained within the sealing layer, thereby joining the upper/lower substrate 216, 214, as shown in FIG. 9D.

Figure 10:
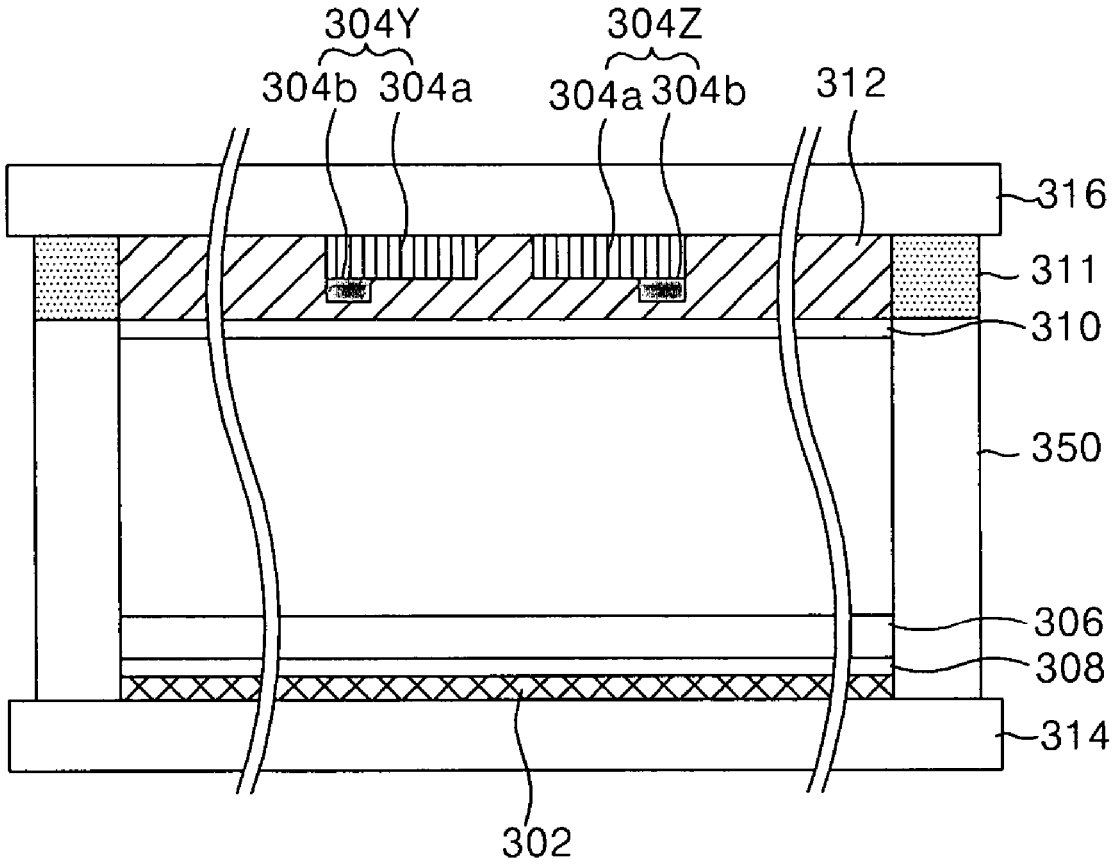
FIG. 10 is a sectional diagram representing a discharge cell structure of a plasma display panel according to a third embodiment of the present invention.

FIG. 10 is a sectional diagram representing a PDP according to a third embodiment of the present invention.

Referring to FIG. 10, the PDP according to the third embodiment of the present invention, when compared with the PDP shown in FIG. 4, has the same components except that it further includes a buffer layer 311 between the upper substrate 316 and the sealing layer 350, so there will be no detail explanation for the same components as shown in FIG. 4.

Figure 11:
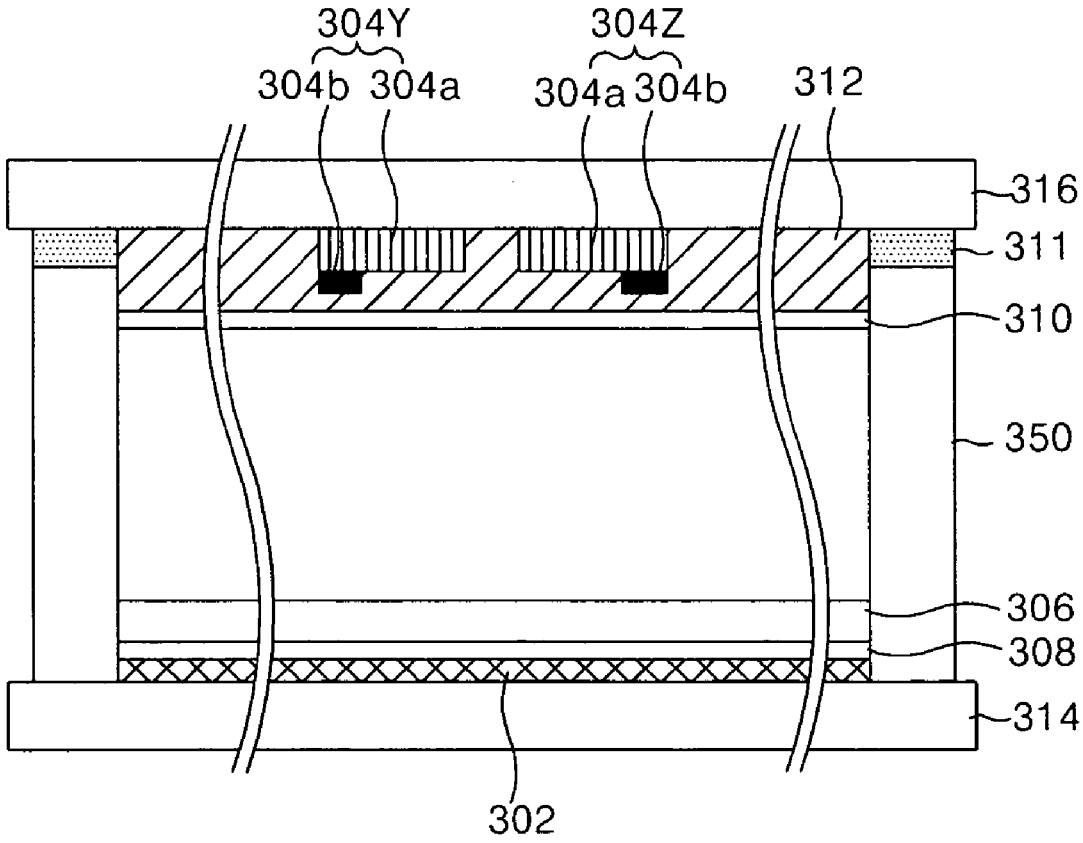
FIG. 11 is a sectional diagram representing that a buffer layer of the plasma display panel according to the third embodiment of the present invention is lower in height than an upper dielectric layer.

The buffer layer 311 is formed on the upper substrate 316 to be in contact with the sealing layer 350 and to have its thickness of 5~50 μm only at the area where it overlaps with the buffer layer 311. Herein, the buffer layer 311 might be formed to have lower height than the upper dielectric layer 311, as shown in FIG. 11.

The buffer layer 311 is made of a material that has its thermal expansion coefficient between the thermal expansion coefficient of the upper substrate 316 and the thermal expansion coefficient of the sealing layer 350. For example, the thermal expansion coefficient of the upper substrate 316 is $80\times10^{-7}$~$95\times10^{-7}$/° C., the thermal expansion coefficient of the sealing layer 350 is $65\times10^{-7}$~$80\times10^{-7}$/° C., and the thermal expansion coefficient of the buffer layer 311 is $72\times10^{-7}$~$86\times10^{-7}$/° C. The material included in the buffer layer 311 is the same material as in the upper dielectric layer 316.

Accordingly, the area of the buffer layer 311 that is in contact with the sealing layer 350 disperses the thermal stress caused by the difference of thermal expansion coefficient between the upper substrate 316 and the sealing layer 350. Since the thermal stress is dispersed by the buffer layer 311, it is possible to prevent a crack from occurring in the upper substrate 316. Herein, the composition and content of the buffer layer 311 is as in table 3, and it is the same as the composition and content of the upper dielectric layer 312.

TABLE 3

| Composition | PbO | $B_2O_3$ | $Al_2O_3$ | $SiO_2$ |
|---|---|---|---|---|
| Content | 45~55% | 10~20% | 10~20% | 15~25% |

Figure 12A:
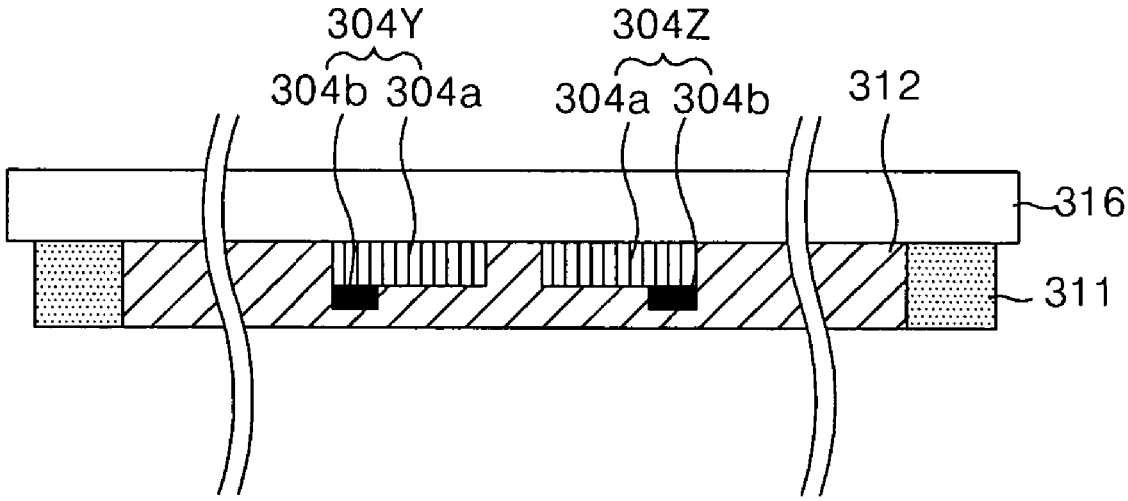
FIGS. 12A to 12C are sectional diagrams representing a sealing process of the plasma display panel according to the third embodiment of the present invention.
Figure 12B:
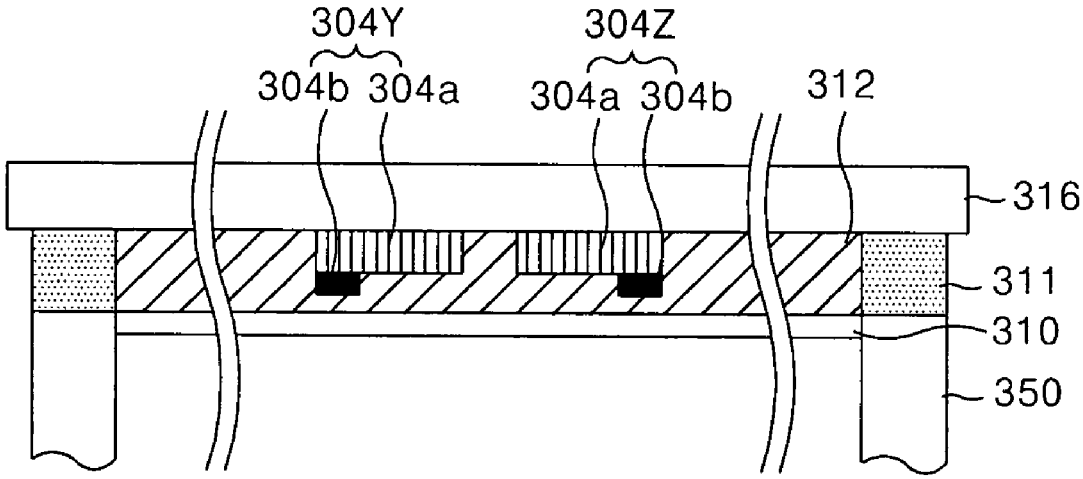
Figure 12C:
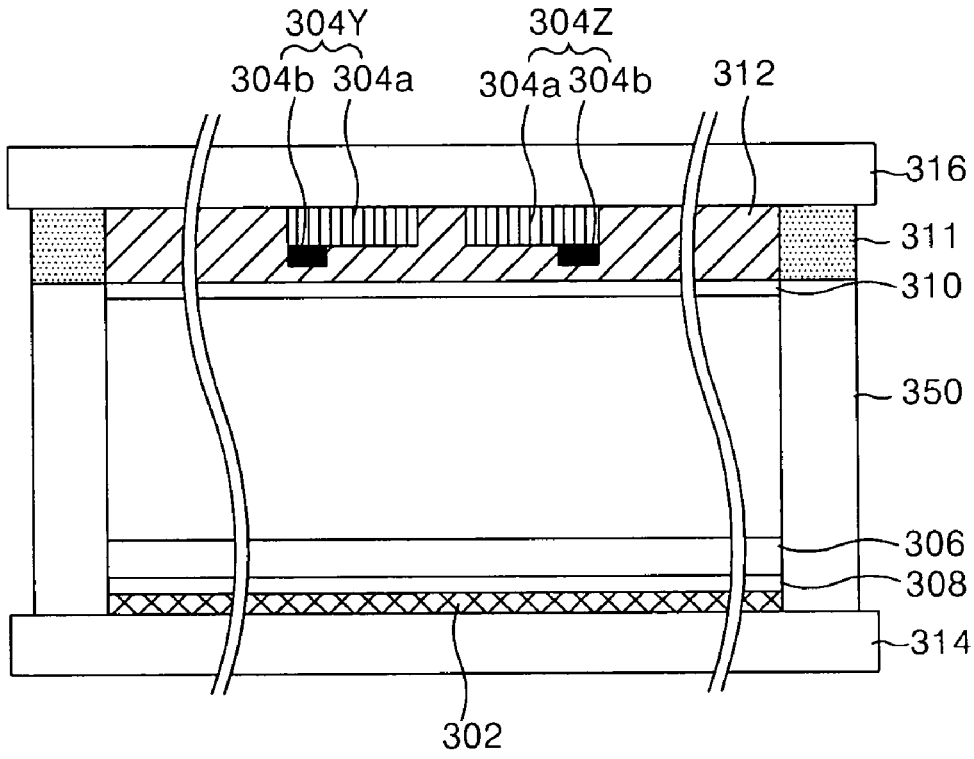

FIGS. 12A to 12C are sectional diagrams representing a sealing process of the PDP according to the embodiment of the present invention.

The buffer layer 311 is formed at an area, which is to be described later, such that the upper substrate 316 overlaps the sealing layer 350 and the buffer layer 311, as shown in FIG. 12B, by spreading a buffer layer material on the upper substrate 316 where the sustain electrode pair 304Y, 304Z have been formed, as shown in FIG. 12A. Then, the upper dielectric layer 312 is formed by spreading a dielectric layer material on the upper substrate 316 except for an area where the buffer layer 311 has been formed. The sealing layer 350 is formed on the upper substrate 316 at areas other than where the upper dielectric layer 312 has been formed, as shown in FIG. 12B. The sealing layer 350 is formed by spreading a paste in use of screen printing or dispenser, wherein the paste is formed by mixing glass powder, solvent and binder together.

Subsequently, a protective film 310 is formed on the upper substrate 316, on which the sealing layer 350 has been formed, by using E-beam deposition or sputtering method under the environment of 200~300° C. Subsequently, the upper substrate 316 where the sealing layer 350 has been formed is aligned with the lower substrate 314. The aligned upper substrate 316 and the lower substrate 314 are fired to remove a large amount of solvent and organic material which is contained within the sealing layer, thereby joining the upper/lower substrate 316, 314, as shown in FIG. 12C.

As described above, a plasma display panel and a fabricating method thereof according to the present invention extends the dielectric layer or forms the buffer layer between the upper substrate and the sealing layer, thereby dispersing the partial thermal stress generated upon heating or cooling due to the difference of thermal expansion coefficient between the upper substrate and the sealing layer, so that the crack on the upper substrate can be prevented.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a first substrate;

a second substrate facing the first substrate;

a plurality of address electrodes on the second substrate, the address electrodes extending in a first direction;

a plurality of other electrodes on the first substrate, the other electrodes extending in a second direction different than the first direction;

a plurality of barrier ribs on the second substrate to form a plurality of discharge cells, the plurality of barrier ribs extending in the first direction a sealing layer located between the first substrate and the second substrate, the sealing layer extending in the second direction, wherein the sealing layer has a thermal expansion coefficient of approximately $65\times10^{-7}$~$80\times10^{-7}$/° C.;

at least one of a buffer layer or a dielectric layer formed between the first substrate and the sealing layer, wherein the at least one of the buffer layer or the dielectric layer has the following composition: PbO at a ratio of 45% to 55%, $B_2O_3$ at a ratio of 10% to 20% and $SiO_2$ at a ratio of 15%–25%; and a protective film formed on the at least one of the buffer layer or the dielectric layer, wherein the at least on of the buffer layer or the dielectric layer has a thermal expansion coefficient different from the thermal expansion coefficient of the sealing layer.

2. The plasma display panel according to claim 1, wherein the buffer layer has the thermal expansion coefficient different from a thermal expansion coefficient of the first substrate.

3. The plasma display panel according to claim 1, wherein the first substrate has a thermal expansion coefficient of approximately $80\times10^{-7}$~$95\times10^{-7}$/° C.

4. The plasma display panel according to claim 1, wherein the buffer layer has the thermal expansion coefficient of approximately $72\times10^{-7}$~$86\times10^{-7}$/° C.

5. The plasma display panel according to claim 1, wherein the plasma display panel includes both the buffer layer and the dielectric layer such that the buffer layer is provided between the first substrate and the dielectric layer and such that the dielectric layer is provided between the buffer layer and the protective film.

6. The plasma display panel according to claim 5, wherein the buffer layer is formed to extend from the dielectric layer.

7. The plasma display panel according to claim 5, wherein the buffer layer is separately formed of a different material than the dielectric layer.

8. The plasma display panel according to claim 1, wherein the at least one of the buffer layer of the dielectric layer has a thickness greater than 35 μm and less than 39 μm between the sealing layer and the first substrate.

9. The plasma display panel according to claim 1, wherein the sealing layer is provided from the second substrate toward the first substrate to a height greater than a height of each of the plurality of barrier ribs.

10. The plasma display panel according to claim 1, further comprising a phosphor formed on the plurality of barrier ribs, wherein the sealing layer is provided from the second substrate to the height that is greater than a height of the phosphor on the barrier ribs.

11. The plasma display panel according to claim 10, wherein the sealing layer comprises glass powder, solvent and binder.

12. A plasma display panel, comprising:

a first substrate;

a second substrate arranged with respect to the first substrate;

a plurality of address electrodes on the second substrate, the address electrodes extending in a first direction;

a plurality of other electrodes on the first substrate, the other electrodes extending in a second direction, the second direction being different than the first direction;

a plurality of barrier ribs on the second substrate, the plurality of barrier ribs extending in the first direction;

a sealing layer located between the first substrate and the second substrate, the sealing layer provided along the second direction, wherein the sealing layer has a thermal expansion coefficient of approximately $65\times10^{-7}$~$80\times10^{-7}$/° C.; and at least one of a buffer layer or a dielectric layer formed between the first substrate and the sealing layer, wherein the at least one of the buffer layer or the dielectric layer has a thermal expansion coefficient of approximately $72\times10^{-7}$/° C. to $85\times10^{-7}$/° C., and wherein thermal expansion coefficient of the at least one of the buffer layer or the dielectric layer is different from the thermal expansion coefficient of the sealing layer.

13. The plasma display according to claim 12, wherein the sealing layer is provided in a third direction from a first end to a second end, the first end located proximal to the first substrate and the second end located proximal to the second substrate, the buffer layer provided only in the area between the first end of the sealing layer and the first substrate.

14. The plasma display panel according to claim 13, wherein a distance from the second end of the sealing layer to the first end of the sealing layer in the third direction is greater than a height of each of the plurality of barrier ribs.

15. The plasma display according to claim 12, further comprising:

another sealing layer between the first substrate and the second substrate; and another buffer layer formed between the first substrate and the another sealing layer, the another buffer layer to compensate thermal stress of the first substrate and the another sealing layer.

16. The plasma display panel according to claim 15, wherein the at least one of the buffer layer or the dielectric layer is the buffer layer, and the plasma display panel further comprises:

an upper dielectric layer formed on the first substrate between the buffer layer and the another buffer layer; and a protective film formed on the upper dielectric layer.

17. The plasma display panel according to claim 12, wherein the thermal expansion coefficient of the buffer layer is different from a thermal expansion coefficient of the first substrate.

18. The plasma display panel according to claim 12, wherein the at least one of the buffer layer or the dielectric layer has the following composition: PbO at a ratio of 45% to 55%, $B_2O_3$ at a ratio of 10% to 20% and $SiO_2$ at a ratio of 15% to 25%.

19. The plasma display panel according to claim 12, wherein the at least one of the buffer layer of the dielectric layer has a thickness greater than 35 μm and less than 39 μm between the sealing layer and the first substrate.

20. The plasma display panel according to claim 12, wherein the sealing layer is provided from the second substrate toward the first substrate to a height greater than a height of each of the plurality of barrier ribs.

21. The plasma display panel according to claim 12, further comprising a phosphor formed on the plurality of barrier ribs, wherein the sealing layer is provided from the second substrate to a height that is greater than a height of the phosphor on the barrier ribs.

22. The plasma display panel according to claim 12, wherein the sealing layer comprises glass powder, solvent and binder.

* * * * *